US006142567A

United States Patent [19]

Bentley

[11] Patent Number: 6,142,567

[45] Date of Patent: Nov. 7, 2000

[54] SUSPENDED SANITARY SEAT

[76] Inventor: Gerald Bentley, 1216 Ferris, Royal Oak, Mich. 48067

[21] Appl. No.: 09/175,530

[22] Filed: Oct. 20, 1998

[51] Int. Cl.[7] ..... A63G 9/12

[52] U.S. Cl. ..... 297/273; 5/120; 5/122

[58] Field of Search ..... 297/273, 274; 5/120, 122

[56] References Cited

U.S. PATENT DOCUMENTS

| | | | |
|---|---|---|---|
| 1,428,039 | 9/1922 | Kratz | 297/273 X |
| 1,569,045 | 1/1926 | Sommer | 5/120 X |
| 2,827,949 | 3/1958 | Kershaw | 5/120 X |
| 3,234,568 | 2/1966 | Fischer . | |
| 3,315,281 | 4/1967 | Morris | 5/120 |
| 3,859,677 | 1/1975 | Nordwig . | |
| 4,222,133 | 9/1980 | Csatary | 5/122 X |
| 4,524,966 | 6/1985 | Shannon et al. | 297/273 X |
| 4,575,073 | 3/1986 | Thacker | 297/273 X |
| 4,828,321 | 5/1989 | Harper | 297/391 |
| 4,944,057 | 7/1990 | Shaw . | |
| 5,197,925 | 3/1993 | Cunard | 297/273 X |
| 5,307,526 | 5/1994 | Appleby | 5/122 X |

*Primary Examiner*—Jose V. Chen
*Assistant Examiner*—Rodney B. White
*Attorney, Agent, or Firm*—Goldstein & Canino

[57] ABSTRACT

A suspended sanitary seat or seating arrangement having a main strap including a first linear portion that transitions into a concaved seat portion, which in turn transitions into a second linear portion. The main strap is configured having a first end and a second end that are used to securely, but removably fix the suspended sanitary seat from a suitable support structure. A transverse strap is further included that extends between lower portions of the first and second linear portions of the main strap to provide support for a user's back while seated in the suspended sanitary seat.

6 Claims, 4 Drawing Sheets

SUSPENDED SANITARY SEAT

BACKGROUND OF THE INVENTION

1. Field of the Invention

The present invention relates to sanitary devices. More particularly, the invention relates to a suspended sanitary seat or sling that may be employed indoors in restroom toilet stalls, or outdoors, for example, when camping.

2. Background and Objects of the Invention

The need to use public or common restroom facilities results in a user contacting surfaces, including toilet seats, etc., wherein the contacted surfaces may be contaminated with urine, feces, and or a variety of germ and micro organisms. In cases where such facilities must be used, it is desirable to reduce or minimize the contacting of such surfaces.

A variety of prior art devices have been proposed that are specifically provided to cover or coat several of the surfaces A variety of prior art devices have been proposed that are specifically provided to cover or coat several of the surfaces encountered in such restrooms. Most notably, there are known in the art paper and plastic covering devices that may be employed to cover, for example, a toilet seat in a public restroom. However, these devices may not be available for user's at a respective facility, and further they may shift or tear during use. In addition, for an elderly or handicapped individual, there is often a need to brace oneself when sitting down and standing up—which means contacting other 'non-covered' surfaces.

There are other devices known in the art that are specifically intended to support and enable the easy movement of elderly or invalid individuals. For example, U.S. Pat. No. 3,234,568 to Fischer, provides a device that includes a complicated sling portion having at least six locations that are connected to a complicated frame and support assembly. This device although may be useful for its intended purpose, is not portable, simple, and easy to deploy (if disassembled). There are a number of other known devices and support systems available in the art that suffer from these same types of limitations.

When considering a temporary or portable bathroom type environment, such as that provided by a 'portable-toilet', or when camping in remote locations, there is a need for simple seating and or support means that may be employed to aid an individual when the need to defecate arises. In particular, it would be useful to provide a very portable, rapidly deployed, sanitary seating solution to individuals having to use public or outdoor facilities that is simple and effective. Accordingly, objects of the present invention are to provide new and improved suspended sanitary seats and seating arrangements having one or more of the following capabilities, features, characteristics, or advantages:

- simple strap based suspended seat or seating arrangement;
- basic design including a main strap having a first linear portion, a curved or concaved seat portion, and a second linear portion;
- configured to removably mount (i.e., be temporarily fixed to) a suitable supporting structure so as to suspend the suspended seat for use in, for example, indoor and outdoor restrooms;
- including a transverse strap portion suitably fixed to the main strap portion to support the back of a user while seated in the suspended seat;
- having at least one grasping opening, or an equivalent, in at least one of the first and second portions of the main strap for grasping when sitting down and getting up from the suspended seat;
- may include a plurality of s-type hooks, or equivalent devices/structures, which may be arranged to mate with one or more (possibly reinforced) holes provided in each of a first end and a second end of main strap portion to enable the suspension of the suspended seat when needed for use;
- easily folded and stored when not in use;
- may be rapidly deployed when needed; and
- inherently low cost and simple design that is easy to manufacture.

The above listed objects, advantages, and associated novel features of the contemplated embodiments of the present invention, as well as others, will become more apparent with a careful review of the description and figures provided within this disclosure. Attention is called to the fact, however, that the drawings and the associated description are illustrative and exemplary only, and variations are certainly possible.

SUMMARY OF THE INVENTION

In accordance with the present invention, a suspended sanitary seat or seating arrangement is provided having a main strap including a first linear portion that transitions into a concaved seat portion, which in turn transitions into a second linear portion. The main strap is configured having a first end and a second end that are distal to the concaved seat portion. The first end is situated at a start of the first portion, while the second end is situated at a start of the second portion.

The main strap may be suspended from a suitable support structure (e.g., the walls of a toilet stall, or a tree when outdoors) by the inclusion of a plurality of spaced holes oriented longitudinally along each of the first linear portion and the second linear portion at each of the first and second end of the main strap. A selected hole from each of the first end and the second end of the main strap is intended to be mated to a suitable stud, or alternately, an s-hook or the like, to enable the suspended (sanitary) seat to be deployed and suspended for use. Each plurality of spaced holes is provided at each of the first end and the second end to enable the adjustment of the height of the concaved seat portion of the suspended sanitary seat above a ground level. Accordingly, the selection of a particular hole (from each plurality of holes) that is to be 'mated' to the stud or s-hook will enable the desired height adjustment to be effected.

It should be noted that the particular arrangement employed to enable the suspended (sanitary) seat to be removably suspended for use may be termed a "means to removably fix" each of the first end and the second end to a suitable supporting structure.

Preferred embodiments of the suspended sanitary seat may further include one or more transverse strap portions, with each having a first end and a second end. The first end of a respective traverse strap is fixed to the main strap portion near where first portion of the main strap transitions to the concaved seat portion, while the second end of the respective traverse strap is fixed to the second portion of the main strap near where the second portion transitions to the concaved seat portion. The transverse strap portion(s) are intended to provide support for a user's back while seated in the suspended sanitary seat.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

LIST OF REFERENCE NUMERALS USED IN THE DRAWINGS

10—suspended sanitary seat or suspended seating arrangement

12—main strap

12*a*—first linear portion

12*aa*—first end (of main strap)

12*b*—second linear portion

12*bb*—second end (of main strap)

12*c*—concaved seat portion

14—transverse strap portion

14*a*—first end of transverse strap portion

14*b*—second end of transverse strap portion

18—(spaced) holes

20—stud (fixed in a suitable support structure)

22—(suitable) support structure

26—grasping opening

28—s-hook

30—ground level

34—toilet

36—(stall or restroom) partition wall

DETAILED DESCRIPTION OF THE PREFERRED EMBODIMENTS

It is important to establish the definition of several terms and expressions that will be used throughout this disclosure. The expression 'suitable supporting structure' is to be defined broadly and indicate any structure that is available and will properly support the suspended sanitary seat of the present invention (e.g., as illustrated). Accordingly, when considering interior bath and restrooms, suitable support structures may include walls adjacent to a toilet, or the partition walls of a stall (having a toilet therein), etc. When considering outdoor locations, a 'suitable support structure' may include trees, one or more sides of a cabin, or a pair of coupled a-type frames structures, or any combination of these items and others available (e.g., the side of a camper vehicle). Skilled persons will appreciate the variety of suitable support structures that may be employed to suspend the present invention. The term 'ground level' may be applied to indicate a floor level (of a bath or restroom), the actual level of the ground surface (at an outdoor site). Additional terms and expressions will be defined below, as required.

Figure 1:
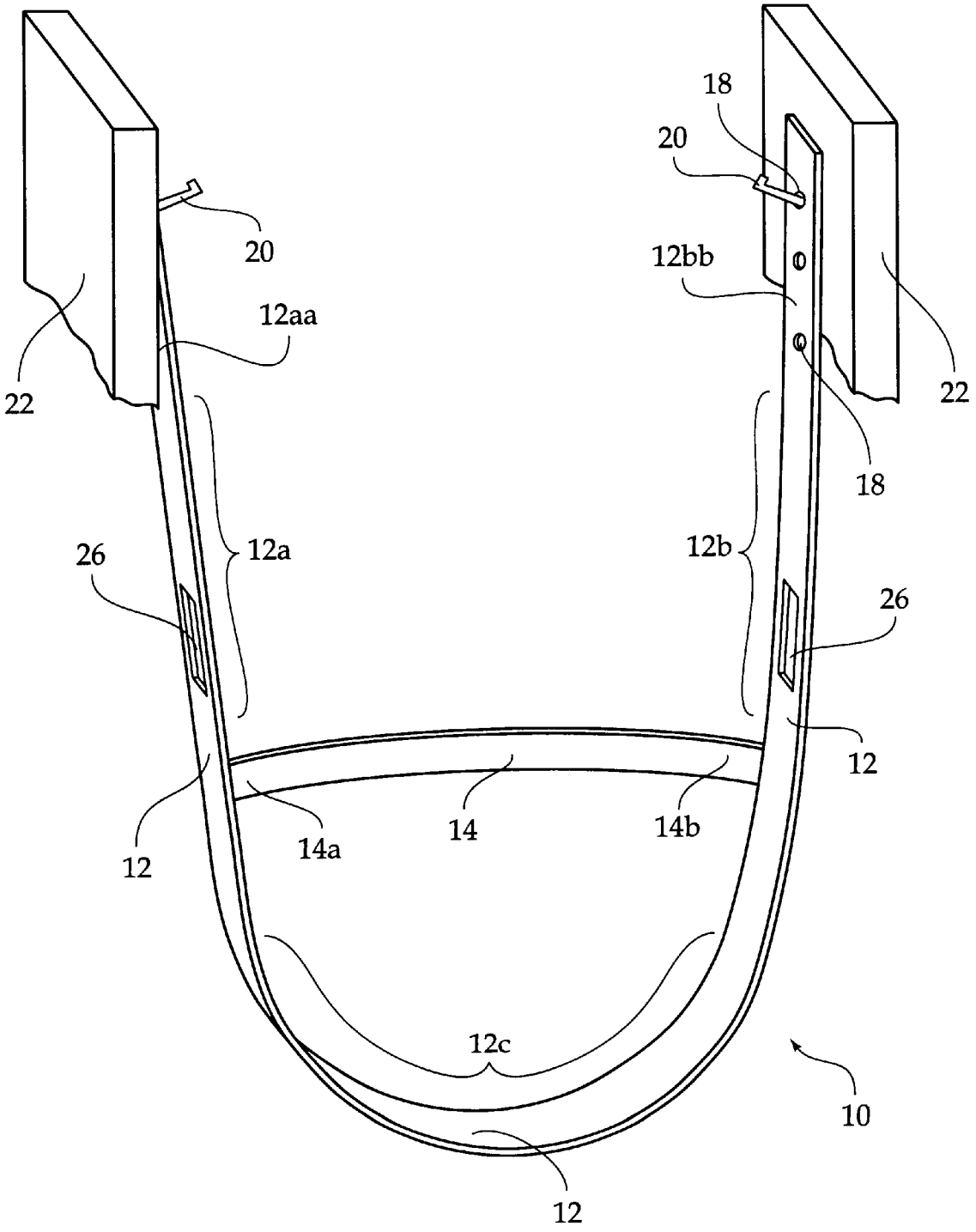
FIG. 1 depicts an embodiment a suspendible sanitary seat in accordance with the present invention.

Turning now to FIG. 1, there is illustrated a suspended sanitary seat 10 having a main strap 12 including a first linear portion 12*a*, which transitions into a concaved seat portion 12*c*, which in turn transitions into a second linear portion 12*b*. The main strap 12 has a first end 12*aa* and a second end 12*bb* that are distal to the concaved seat portion 12*c*. That is, the first end 12*aa* of the main strap 12 is located at a start of the first portion 12*a*, while the second end 12*bb* located at a start of the second portion 12*b*.

Importantly, the present invention further includes a means to 'removably fix' each of the first end 12*aa* and the second end 12*bb* to a suitable supporting structure so as to properly and solidly suspend the suspended sanitary seat 10 for use. As can be seen in FIG. 1, one embodiment of the means to removably fix the first and second ends, 12*aa* and 12*bb*, respectively, may be provided by a plurality of spaced holes 18, which are oriented longitudinally along each of the first linear portion 12*a* and the second linear portion 12*b*, proximal to each of the first end 12*aa* and second end 12*bb* of the main strap 12. Each plurality of spaced holes 18 are provided to enable the suspension of the suspended sanitary seat 10, while also enabling the adjustment of a height established for the concaved seat portion 12*c* above a ground level. As shown, by simply 'mating' a selected pair of the holes (one at each strap end 12*aa* and 12*bb*) to, for example as illustrated, a stud 20 provided in and extending from a suitably spaced support structure 22, the present invention may be deployed and suspended. It should be noted that the studs must be provided at an inclined angle to properly and securely support the suspended sanitary seat 10 while in use. Other arrangements that may be employed to suspend and deploy the present invention will be discussed below while referring to FIGS. 2 and 3.

Figure 2:
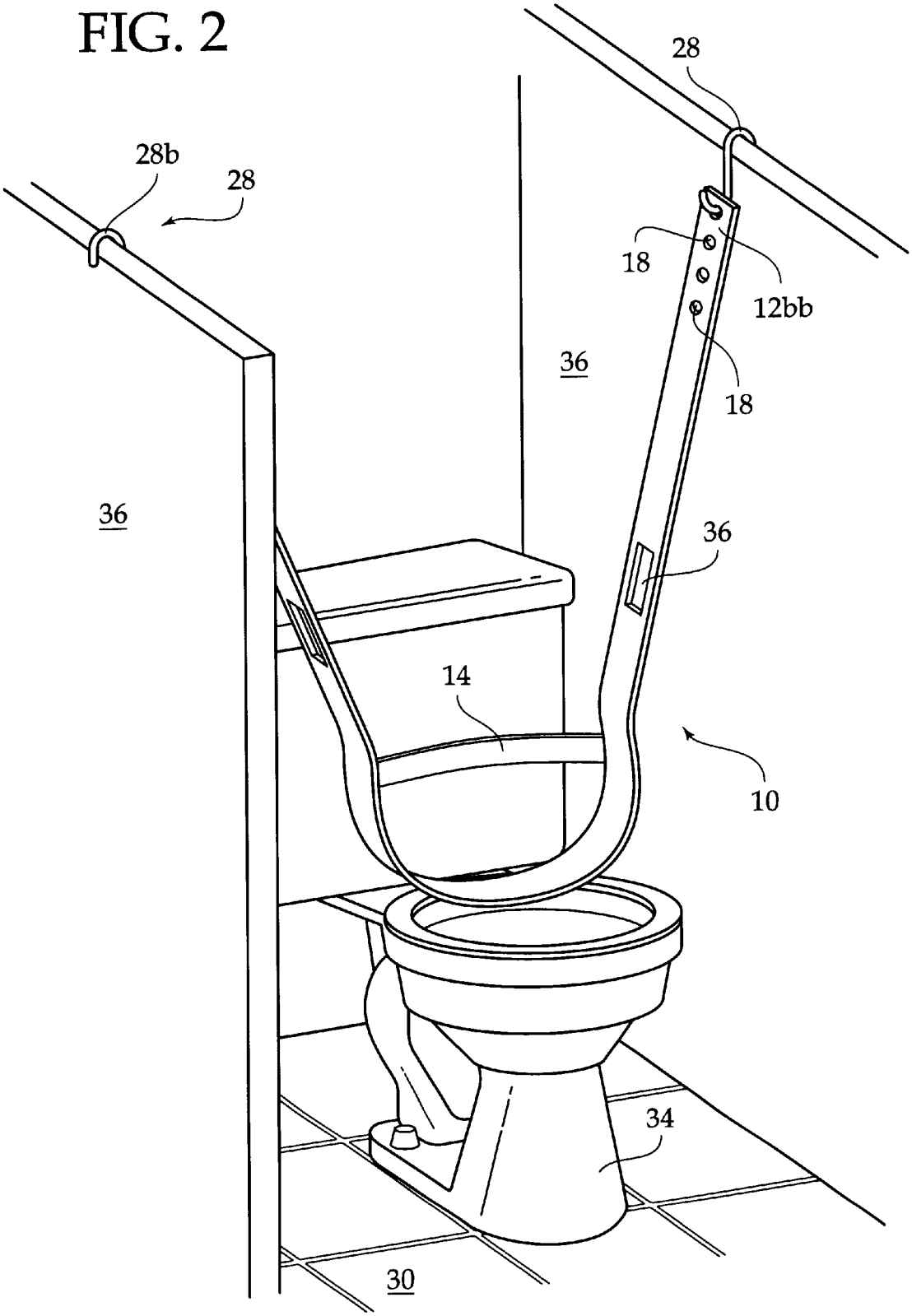
FIG. 2 illustrates a suspended sanitary seat deployed in a toilet stall found in public or common restrooms.

In a preferred embodiment of the suspended sanitary seat 10 at least one transverse strap portion 14 would be provided, as clearly seen in FIGS. 1 and 2. The transverse strap portion 14 is configured having a first end 14*a* and a second end 14*b*. The first end 14*a* of the traverse strap portion 14 is fixed to the main strap 12 near where the first linear portion 12*a* of the main strap 12 transitions to the concaved seat portion 12*c*. Similarly, the second end 14*b* of the traverse strap portion 14 is fixed to the second linear portion 12*b* of the main strap 12 near where the second linear portion 12*b* transitions to the concaved seat portion 12*c*. The transverse strap is included to provide support for a user's back while seated in the suspended sanitary seat 10.

Another feature providable in preferred embodiments of the suspended sanitary seat 10 is at least one grasping opening 26 cut or formed into at least one of the first and second linear portions 12*a* and 12*b*, respectively. Preferably, at least one grasping opening 26 would be provided in each of the first and second linear portions of the main strap 12. The grasping openings 26 are contemplated to be suitably sized and located to enable a user to insert a hand therein for grasping when sitting down and getting up from the suspended sanitary seat 10. It may be desirable to include several grasping openings 26 on each of the first and second linear portions 12*a* and 12*b*.

Figure 3:
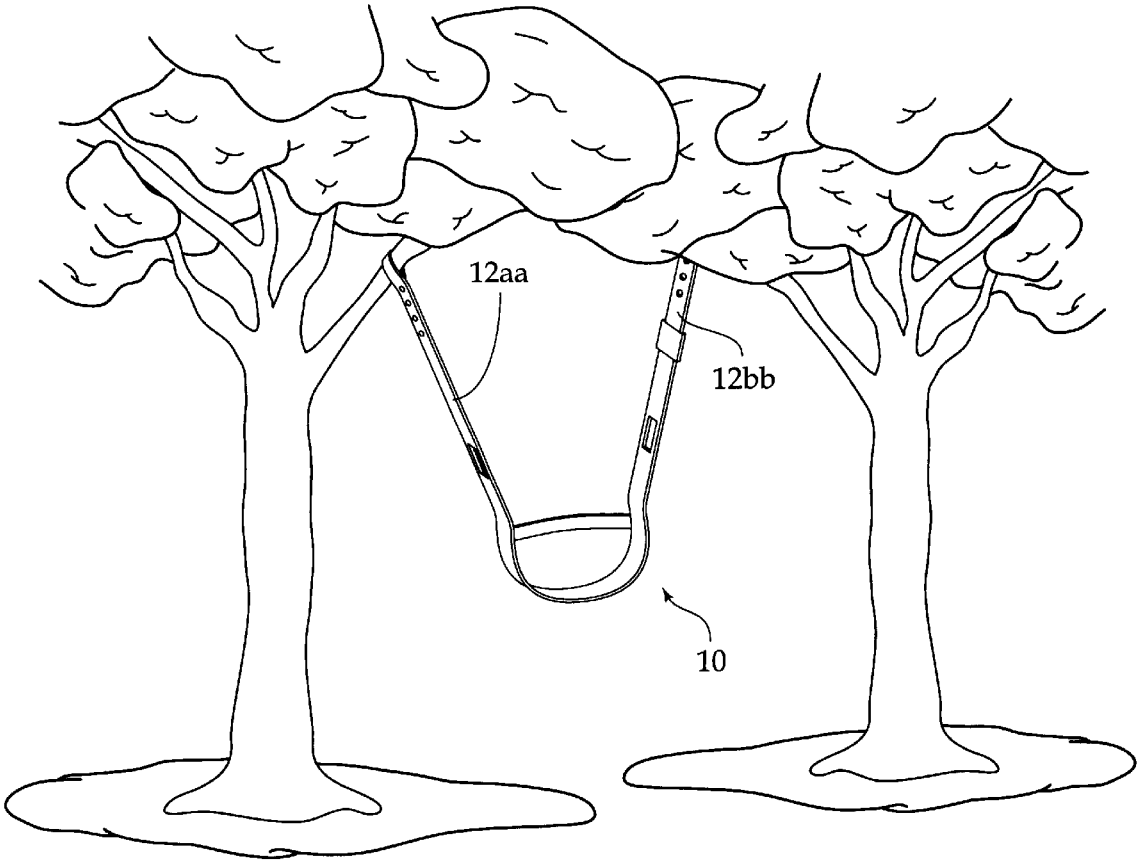
FIG. 3 depicts the suspended sanitary seat deployed in the outdoors, for example, near a remote camping location.
Figure 4A:
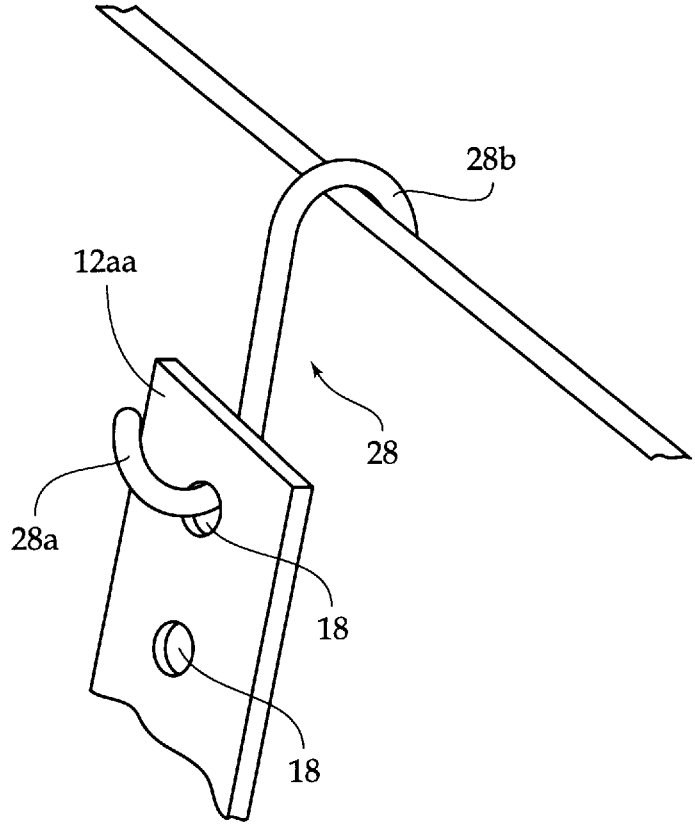
FIGS. 4A and 4B shows an embodiment of a means to removably suspend a first end and second end of a main strap included with the suspended sanitary seat in accordance with the invention.
Figure 4B:
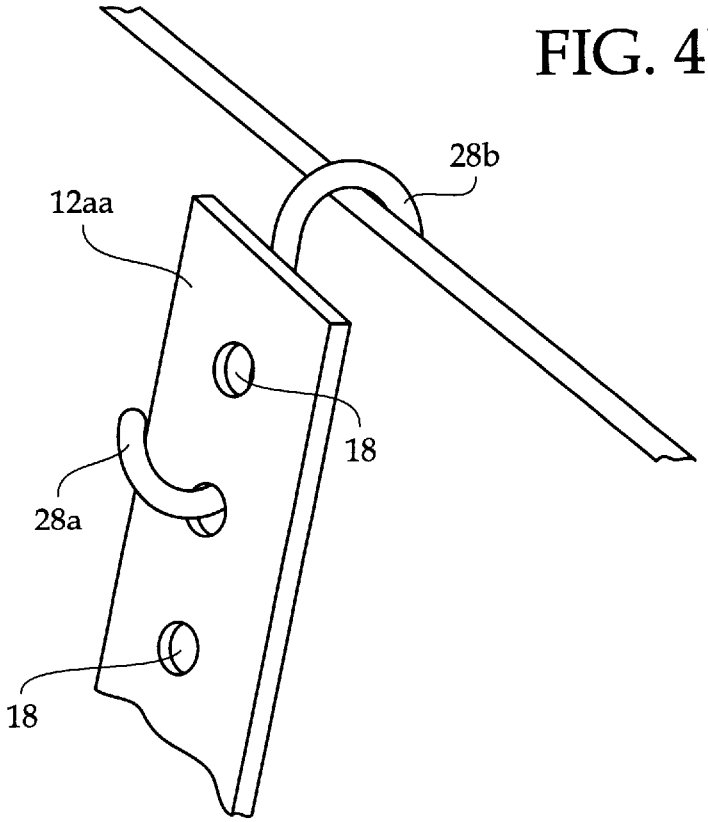

Referring now to FIG. 2, there is depicted the suspended sanitary seat 10 of the present invention deployed in a typical restroom toilet stall over a toilet 34. As shown, a means to removably fix each of the first end 12*aa* and the second end 12*bb* of the main strap 12 to a pair of stall partitions 36 (i.e., a suitable support structure) includes a plurality of s-hooks. As can be seen in FIGS. 4A and 4B, each s-hook 28 is configured having a first hook end 28*a* and a second hook end 28*b*. The first hook end 28*a* is mated with a selected one of a plurality of holes 18 (as shown in FIGS. 4A and 4B) that are provided in each of the first and the second ends (12*aa* and 12*bb*) of main strap 12. The second hook end 12*b* is configured to hook onto a top edge of the stall partition walls 36. Skilled individuals will recognize that other equivalent arrangements employing s-hooks, loops and eyelets (not illustrated), etc., may be employed to suspend the present invention in a variety of settings. For example, as shown in FIG. 3, the suspended sanitary seat 10 is contemplated for use outdoors. In an outdoor setting one or more (possibly) differing means may be employed to suspend the suspended sanitary seat 10. In FIG. 3, the present invention is suspended from a tree limb. Alternately, when considering outdoor settings, shack or cabin walls, several trees, etc., may be employed to suspend and deploy the suspended sanitary seat 10.

It is important to understand that the description of the embodiments of the suspended sanitary seat 10, are illustrative only, and other equivalent arrangements are certainly possible. For example, the width of the first and second linear portions, 12*aa* and 12*bb*, respectively, may be altered to enable in-line grasping rings (not illustrated) to be provided, which would replace the grasping openings 26. Further, the width of the concaved seat portion 12*c* may be made wider than illustrated. In addition, the concaved seat portion may be coated with a plastic covering to enable easy cleanup. Accordingly, while there have been described the currently preferred embodiments of the invention, those skilled in the art will recognize that other and further modifications may be made without departing from the present invention, and it is intended to claim all such modifications and variations as fall within the scope of the appended claims.

What is claimed is:

1. A suspended sanitary seat, comprising:

a) a main strap including a first linear portion, which transitions into a concaved seat portion, which transitions into a second linear portion, the linear portions extending upwardly from the concaved seat portion and opposite each other;

b) the main strap having a first end and a second end that are distal to the concaved seat portion, with the first end located at a start of the first portion and the second end located at a start of the second portion, and the first and second ends being approximately opposite each other; and c) means to removably fix each of the first end and the second end to a suitable supporting structure so as to suspend the suspended sanitary seat for use.

2. The suspended sanitary seat according to claim 1, further including at least one transverse strap portion having a first end and a second end, with the first end of the traverse strap portion fixed to the main strap near where the first linear portion of the main strap transitions to the concaved seat portion and the second end of the traverse strap portion fixed to the second linear portion of the main strap near where the second portion transitions to the concaved seat portion; each included transverse strap portion providing support for a user's back while seated in the suspended sanitary seat.

3. The suspended sanitary seat according to claim 2, further including at least one grasping opening formed into at least one of the first and second linear portions, the grasping openings suitably sized and located to enable a user to insert a hand therein for grasping when sitting down and getting up from the suspended sanitary seat.

4. The suspended sanitary seat according to claim 1, wherein the means to removably fix each of the first end and the second end of the main strap to a suitable support structure includes an s-hook having a first hook end and a second hook end, with the first hook end configured to mate with a hole provided in each of the first and the second end of main strap, and the second hook end configured to hook onto the suitable support structure.

5. The suspended sanitary seat according to claim 4, wherein a plurality of holes are provided at spaced locations at each of the first end and the second end along the main strap, each plurality of holes provided at each of the first end and second end of the main strap to enable an adjustment of a height established for the concaved seat portion of the suspended sanitary seat above a ground level.

6. The suspended sanitary seat according to claim 1, wherein the means to removably fix each of the first end and the second end of the main strap to a suitable support structure includes a plurality of spaced holes oriented longitudinally along each the first linear portion and the second linear portion proximal to each of the first end and second end of the main strap, each plurality of spaced holes provided to enable an adjustment of a height established for the concaved seat portion of the suspended sanitary seat above a ground level, the holes configured to be mated to a stud provided in and extending from the suitable support structure at an inclined angle thereto.

* * * * *